US006563086B1

(12) United States Patent
Meirndorf et al.

(10) Patent No.: US 6,563,086 B1
(45) Date of Patent: May 13, 2003

(54) VEHICLE LIGHTS DEFROSTER DEVICE

(76) Inventors: Carl E. Meirndorf, 1023 W. Columbia Rd., Mason, MI (US) 48854; Valerie L. Meirndorf, 1023 W. Columbia Rd., Mason, MI (US) 48854

( * ) Notice: Subject to any disclaimer, the term of this patent is extended or adjusted under 35 U.S.C. 154(b) by 0 days.

(21) Appl. No.: 10/056,330

(22) Filed: Jan. 25, 2002

(51) Int. Cl.[7] ..... H05B 3/00

(52) U.S. Cl. ..... 219/220; 219/202; 219/522; 219/541; 219/540; 362/311; 362/541; 362/455

(58) Field of Search ..... 219/220, 202, 219/522, 541, 540; 362/541–542, 546, 376, 311, 455; 359/512; 15/250.001, 250.002, 250.05

(56) References Cited

U.S. PATENT DOCUMENTS

| | | | | |
|---|---|---|---|---|
| 1,120,987 A | * | 12/1914 | Vogel | 219/540 |
| 2,442,913 A | | 6/1948 | Abrams et al. | |
| 2,765,391 A | * | 11/1956 | Shroyer | 219/540 |
| 3,349,224 A | * | 10/1967 | Jaeger | 219/540 |
| 4,388,522 A | | 6/1983 | Boaz | |
| 4,728,775 A | * | 3/1988 | Straten | 219/202 |
| D313,865 S | | 1/1991 | Armacost, Jr. et al. | |
| 5,182,432 A | * | 1/1993 | Lange et al. | 219/202 |
| 5,420,774 A | | 5/1995 | Wilson | |
| 5,493,102 A | | 2/1996 | Takase et al. | |

FOREIGN PATENT DOCUMENTS

| | | |
|---|---|---|
| DE | 4333655 | * 4/1995 |
| DE | 19724098 | * 12/1998 |
| DE | 19825437 | * 8/1999 |
| DE | 20012483 | * 11/2000 |
| FR | 2666906 | * 3/1992 |
| GB | 1560625 | * 2/1980 |
| JP | 10-289602 | * 10/1998 |

* cited by examiner

*Primary Examiner*—John A. Jeffery

(57) ABSTRACT

A vehicle lights defroster device for ensuring that motorists following the school bus see the flashing lights. The vehicle lights defroster device includes a cover member being essentially transparent and having an outer rim and being adapted to fastenably mount upon a light of a vehicle; and also includes a heating element extending throughout the cover member; and further includes a connecting assembly for connecting the heating element to a power source for energizing the heating element.

5 Claims, 2 Drawing Sheets

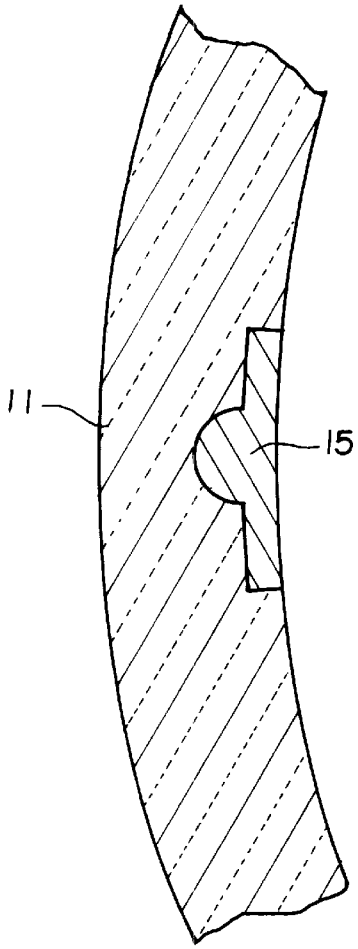
FIG.3
FIG.4
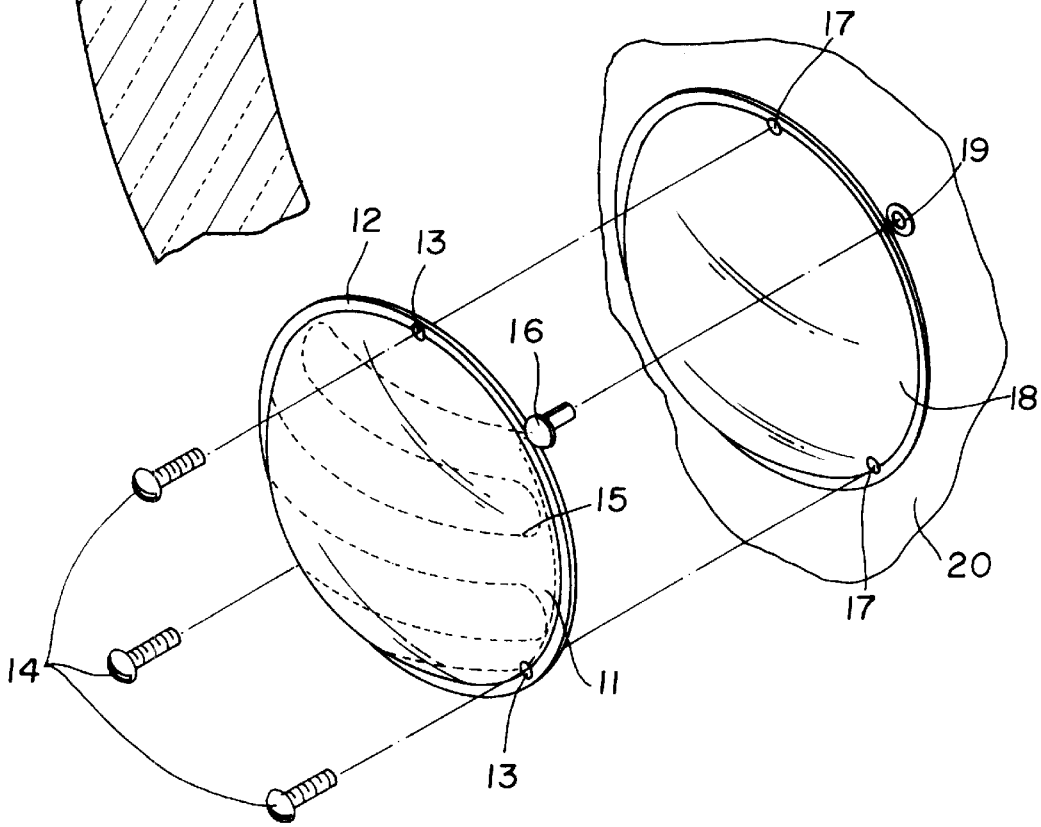

VEHICLE LIGHTS DEFROSTER DEVICE

BACKGROUND OF THE INVENTION

1. Field of the Invention

The present invention relates to a flashing light defroster for a vehicle and more particularly pertains to a new vehicle lights defroster device for ensuring that motorists following the school bus see the flashing lights.

2. Description of the Prior Art

The use of a flashing light defroster for a vehicle is known in the prior art. More specifically, a flashing light defroster for a vehicle heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,388,522; 5,420,774; 4,728,775; 2,442,913; 5,493,102; and Des. 313,865.

While these devices fulfill their respective, particular objectives and requirements, the aforementioned patents do not disclose a new vehicle lights defroster device. The inventive device includes a cover member being essentially transparent and having an outer rim and being adapted to fastenably mount upon a light of a vehicle; and also includes a heating element extending throughout the cover member; and further includes a connecting assembly for connecting the heating element to a power source for energizing the heating element.

In these respects, the vehicle lights defroster device according to the present invention substantially departs from the conventional concepts and designs of the prior art, and in so doing provides an apparatus primarily developed for the purpose of ensuring that motorists following the school bus see the flashing lights.

SUMMARY OF THE INVENTION

In view of the foregoing disadvantages inherent in the known types of flashing light defroster for a vehicle now present in the prior art, the present invention provides a new vehicle lights defroster device construction wherein the same can be utilized for ensuring that motorists following the school bus see the flashing lights.

The general purpose of the present invention, which will be described subsequently in greater detail, is to provide a new vehicle lights defroster device which has many of the advantages of the flashing light defroster for a vehicle mentioned heretofore and many novel features that result in a new vehicle lights defroster device which is not anticipated, rendered obvious, suggested, or even implied by any of the prior art flashing light defroster for a vehicle, either alone or in any combination thereof.

To attain this, the present invention generally comprises a cover member being essentially transparent and having an outer rim and being adapted to fastenably mount upon a light of a vehicle; and also includes a heating element extending throughout the cover member; and further includes a connecting assembly for connecting the heating element to a power source for energizing the heating element.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new vehicle lights defroster device which has many of the advantages of the flashing light defroster for a vehicle mentioned heretofore and many novel features that result in a new vehicle lights defroster device which is not anticipated, rendered obvious, suggested, or even implied by any of the prior art flashing light defroster for a vehicle, either alone or in any combination thereof.

It is another object of the present invention to provide a new vehicle lights defroster device which may be easily and efficiently manufactured and marketed.

It is a further object of the present invention to provide a new vehicle lights defroster device which is of a durable and reliable construction.

An even further object of the present invention is to provide a new vehicle lights defroster device which is susceptible of a low cost of manufacture with regard to both materials and labor, and which accordingly is then susceptible of low prices of sale to the consuming public, thereby making such vehicle lights defroster device economically available to the buying public.

Still yet another object of the present invention is to provide a new vehicle lights defroster device which provides in the apparatuses and methods of the prior art some of the advantages thereof, while simultaneously overcoming some of the disadvantages normally associated therewith.

Still another object of the present invention is to provide a new vehicle lights defroster device for ensuring that motorists following the school bus see the flashing lights.

Yet another object of the present invention is to provide a new vehicle lights defroster device which includes a cover member being essentially transparent and having an outer rim and being adapted to fastenably mount upon a light of a vehicle; and also includes a heating element extending throughout the cover member; and further includes a connecting assembly for connecting the heating element to a power source for energizing the heating element.

Still yet another object of the present invention is to provide a new vehicle lights defroster device that effectively defrosts and makes visible the flashing lights of a school bus.

Even still another object of the present invention is to provide a new vehicle lights defroster device that substantially increases safety around school buses.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view of the present invention.

FIG. 4 is a perspective view of the present invention being mounted about a light of a vehicle.

DESCRIPTION OF THE PREFERRED EMBODIMENT

Figure 1:
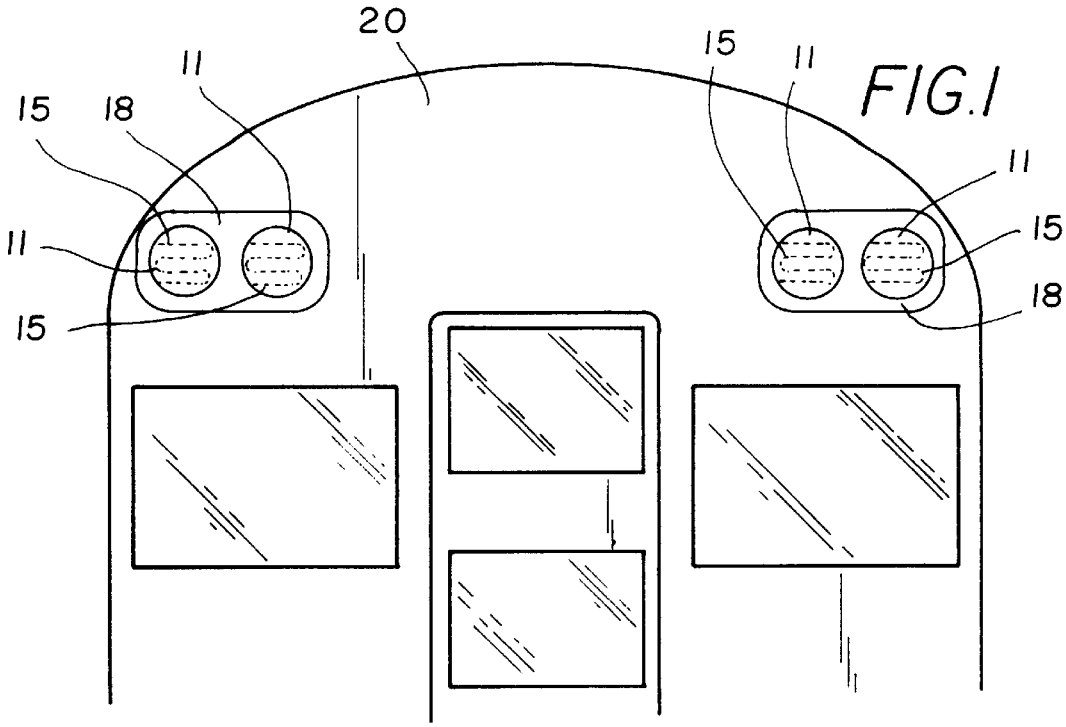
FIG. 1 is a front elevational of a new vehicle lights defroster device according to the present invention shown in use upon a school bus.
Figure 2:
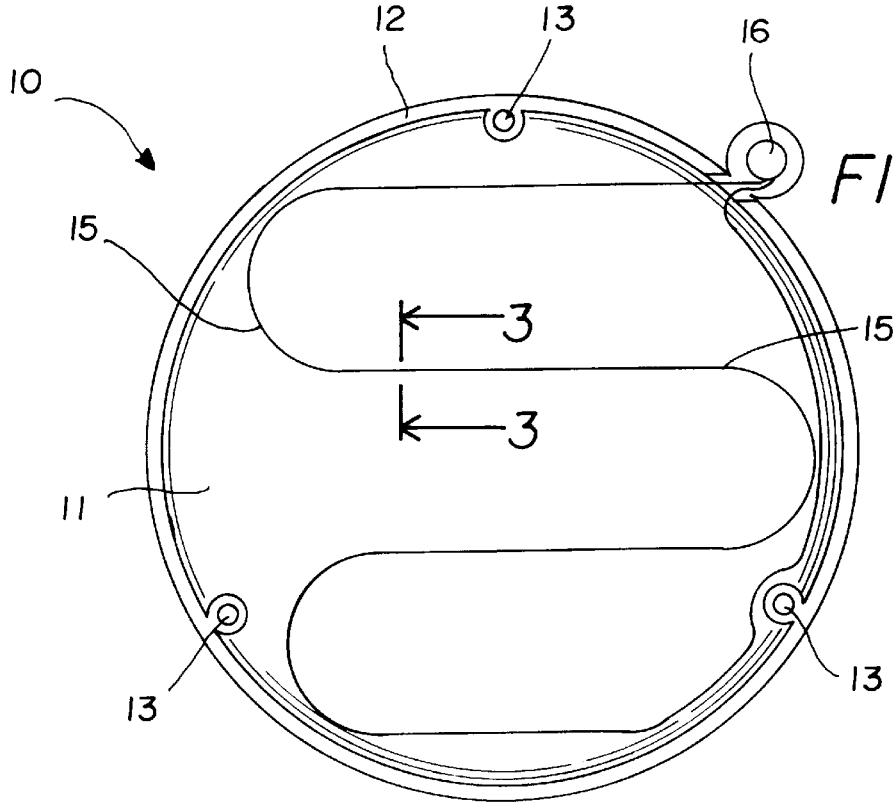
FIG. 2 is a front elevational view of the present invention.

With reference now to the drawings, and in particular to FIGS. 1 through 4 thereof, a new vehicle lights defroster device embodying the principles and concepts of the present invention and generally designated by the reference numeral 10 will be described.

As best illustrated in FIGS. 1 through 4, the vehicle lights defroster device 10 generally comprises a cover member 11 being essentially transparent and having an outer rim 12 and being adapted to fastenably mount with fasteners 14 upon a light 18 of a vehicle. The cover member 11 is essentially made of glass with the outer rim 12 being made of metal. Further, the cover member 11 is essentially a concavo-convex lens with the outer rim 12 including a plurality of holes 13 spaced therealong and extending therethrough and being adapted to be in alignment with mounting holes 17 about the light 18 of the vehicle.

A heating element 15 extends throughout inside the cover member 11 with the heating element 15 being essentially a continuous wire which winds back and forth in the concavo-convex lens to effectively cover all of the concavo-convex lens.

Means for connecting the heating element 15 to a power source for energizing the heating element 15 includes a plug 16 being conventionally connected to the heating element 15 and being adapted to be received in a jack 19 disposed in a body 20 of the vehicle and which is connected to a battery of the vehicle for energizing the heating element 15.

In use, the user replaces the standard cover member used on vehicles such as that used on the flashing lights 18 of a school bus with the cover member 11 of the present invention by fastening the cover member 11 directly upon the same mounting holes 17 disposed about the flashing light 18, and then inserts the plug 16 into the jack 19 installed in the body 20 of the vehicle which is connected to the power source of the vehicle to energize the heating element 15 to defrost the cover member 11 so that the flashing lights 18 of the school bus can be seen by other motorists.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A vehicle light defroster device comprising:

a cover member for covering a light of the vehicle, said cover member having an outer rim and being adapted to fastenably mount upon the light of the vehicle;

a heating element for increasing a temperature of said cover member, said heating element being integrally mounted in said cover member and being disposed on said cover member in a serpentine fashion for maximizing an area of said cover member heated when said heating element is activated;

said heating element comprising a wire having a generally rectangular cross-section as taken perpendicular to a longitudinal axis of said wire, said wire having a bulbous center portion extending away from an outermost side of said wire towards a middle part of said cover member for maximizing a surface area of said wire contacting said cover member; and a connecting means for connecting said heating element to a power source for energizing said heating element;

wherein said means for connecting said heating element to a power source comprises a pin member mounted to said outer rim, said pin member being oriented substantially perpendicular to a plane of said outer rim to facilitate coupling to an electrical jack disposed in a body of the vehicle, said pin member being electrically coupled to said heating element; and wherein said jack is electrically coupled to a battery of the vehicle in a manner allowing a user to selectively energize said heating element.

2. A vehicle light defroster device as described in claim 1, wherein said cover member comprises glass such that said cover member has a generally high degree of thermal conductivity; and wherein said outer rim is made of metal.

3. A vehicle light defroster device as described in claim 1, wherein said cover member is essentially a concavo-convex lens.

4. A vehicle light defroster device as described in claim 1, wherein said outer rim includes a plurality of holes spaced therealong and extending therethrough and being adapted to be in alignment with mounting holes about the light of the vehicle.

5. A vehicle light defroster device comprising:

a cover member for covering a light of a vehicle, said cover member having an outer rim and being adapted to fastenably mount upon the light of a vehicle, said cover member comprising glass such that said cover member has a generally high degree of thermal conductivity, said cover member comprising a concavo-convex lens, said outer rim being made of metal, wherein said outer rim includes a plurality of holes spaced therealong and extending therethrough and being alignable with mounting holes about the light of the vehicle;

a heating element for increasing a temperature of said cover member, said heating element being integrally mounted in said cover member and being disposed on said cover member in a serpentine fashion for maximizing an area of said cover member heated when said heating element is activated, said heating element comprising a wire having a generally rectangular cross-section as taken perpendicular to a longitudinal axis of said wire, said wire having a bulbous center portion extending away from an outermost side of said wire towards a middle part of said cover member for maximizing a surface area of said wire contacting said cover member; and a connecting means for connecting said heating element to a power source for energizing said heating element, said connecting means comprising a pin member mounted to said outer rim, said pin member being oriented substantially perpendicular to a plane of said outer rim to facilitate coupling to an electrical jack disposed in a body of the vehicle when said cover member is mounted upon the light of the vehicle, said pin member being electrically coupled to said heating element, said jack being electrically coupled to a battery of the vehicle in a manner allowing a user to selectively energize said heating element.

* * * * *